US006143487A

United States Patent [19]

Philip et al.

[11] Patent Number: 6,143,487

[45] Date of Patent: Nov. 7, 2000

[54] PHOTOTHERMOGRAPHIC ELEMENTS

[75] Inventors: James B. Philip, Mahtomedi; Ivan H. Skoog, Lake Elmo; Gary L. Featherstone, Oakdale; Thomas J. Kub, West Lakeland Township, all of Minn.

[73] Assignee: Eastman Kodak Company, Rochester, N.Y.

[21] Appl. No.: 07/983,304

[22] Filed: Nov. 30, 1992

[51] Int. Cl.[7] ..... G03C 1/498; G03C 1/34

[52] U.S. Cl. ..... 430/619; 430/531; 430/603; 430/607; 430/611; 430/622

[58] Field of Search ..... 430/619, 603, 430/617, 611, 531, 607, 622

[56] References Cited

U.S. PATENT DOCUMENTS

| | | | |
|---|---|---|---|
| 3,839,041 | 10/1974 | Hiller . | |
| 3,839,042 | 10/1974 | Silverman et al. | 430/621 |
| 4,281,060 | 7/1981 | Usami et al. | 430/618 |
| 4,459,350 | 7/1984 | Przezdziecki . | |
| 4,840,882 | 6/1989 | Iwagaki et al. | 430/505 |
| 4,983,494 | 1/1991 | Kitaguchi et al. . | |

FOREIGN PATENT DOCUMENTS

| | | |
|---|---|---|
| 61 18942 | 7/1984 | Japan . |
| 61-018942 | 7/1984 | Japan . |
| 62-177546 | 4/1987 | Japan . |
| 3 114043 | 11/1989 | Japan . |
| 31-14043 | 6/1991 | Japan . |

*Primary Examiner*—Thorl Chea
*Attorney, Agent, or Firm*—Mark A. Litman; J. Lanny Tucker

[57] ABSTRACT

Vinyl sulfone and/or β-halo sulfone compounds have been found to improve fog stability on shelf aging of photothermographic imaging elements. These elements comprise a photosensitive silver halide, silver salt oxidizing agent and reducing agent for silver ion in a binder.

24 Claims, No Drawings

PHOTOTHERMOGRAPHIC ELEMENTS

BACKGROUND OF THE INVENTION

1. Field of the Invention

The invention relates to a photothermographic silver halide material and method for producing in such a material improved fog stability on shelf aging by incorporating vinyl sulfones and/or β-halo sulfones.

2. Background of the Art

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

Photothermographic emulsions, in a manner similar to photographic emulsions and other light sensitive systems, tend to suffer from fog. Fog is spurious image density which appears in unexposed areas of the element and is often reported in semitometric results as $D_{min}$.

Traditionally, photothermographic materials have suffered from fog instability on shelf aging. The fog level rises steadily as the materials reach extended age such as one year at room temperature (ambient conditions). Adding to the difficulty of fog control on shelf aging is the fact that the developer is incorporated in the photothermographic element, which is not the case in most silver halide photographic systems. The need for shelf life extenders in photothermographic elements is therefore considered to be very important.

The fog level of freshly prepared photothermographic materials will be referred to as initial fog. A great deal of effort has been directed towards minimizing the initial fog and stabilizing the fog level on shelf aging. Mercuric salts are described as antifoggants in U.S. Pat. No. 3,589,903. Fog reduction has been described for organic carboxylic acids such as benzoic and phthalic acids in U.S. Pat. No. 4,152,160, for benzoyl benzoic acid compounds in U.S. Pat. No. 4,784,939, for indane or tetralin carboxylic acids in U.S. Pat. No. 4,569,906, for dicarboxylic acids in U.S. Pat. No. 4,820,617 and for heteroaromatic carboxylic acids in U.S. Pat. No. 4,626,500. Halogenated compounds have also been shown to be strong antifoggants and are described in U.S. Pat. Nos. 4,546,075, 4,756,999, 4,452,885, 3,874,946 and 3,955,982. Halogen molecules or halogen molecules associated with a heteroatom ring are also useful antifoggants and are described in U.S. Pat. No. 5,028,523. However, these compounds individually or in combination were not found to produce sufficient fog stability on shelf life aging of the photothermographic element.

Vinyl sulfones, and to a lesser extent β-halo sulfones, have been used extensively in photographic constructions as gelatin hardeners or crosslinking agents. In order to crosslink the gelatin, two or more vinyl sulfonyl groups or two or more β-halo sulfonyl groups are attached to the same molecule by a linking group. Examples of these gelatin hardening agents are found in U.S. Pat. Nos. 3,839,042, 3,841,872 and 3,957,882.

Many additional patents on gelatin hardening by vinyl sulfones and β-halo sulfones have appeared covering modifications to the linking group. The modifications include the addition of water solubilizing groups as in U.S. Pat. Nos. 4,173,481, 4,142,897 and 4,323,646 and the incorporation of a heteroatom in U.S. Pat. Nos. 3,490,911, 3,642,486 and 4,134,770. Additional patents have been issued covering three or more vinyl groups on a compound (U.S. Pat. No. 4,088,495) and the use of polymeric vinyl sulfone and β-halo sulfones as in U.S. Pat. No. 4,956,270 and Japanese Patent Application J63123039-A.

Vinyl sulfones and β-halo sulfones have received less attention in photothermographic systems. In the photothermographic systems, they have again been used to harden or crosslink a hydrophilic binder. They are referred to as hardeners for hydrophilic binders in Japanese Patent Application JO 3114043A and JP 61018942A and in a thermal transfer system covered by Japanese Patent Application J6 2177546A and in a color dye diffusion system outlined in U.S. Pat. No. 4,840,882. Our system varies greatly from these in that the vinyl sulfones and β-halo sulfones are used with hydrophobic binders and no hardening or crosslinking is observed.

BRIEF DESCRIPTION OF THE INVENTION

The addition of a vinyl sulfone and/or a β-halo sulfone has been found to be a very effective antifoggant system and greatly improves fog stability on shelf aging of photothermographic, silver halide emulsions.

DETAILED DESCRIPTION OF THE INVENTION

The generation of fog, in particular on shelf aging, in photothermographic elements comprising photosensitive silver halide, organic silver salt oxidizing agent and reducing agent for silver ion can be reduced by the addition of a vinyl sulfone and/or a β-halo sulfone.

It has been found in the present invention that vinyl sulfones (I) and/or β-halo sulfones (II) increase the fog stability of photothermographic emulsions.

$$(CH_2{=}CH{-}SO_2)_nL \quad \text{(I)}$$

$$(XCH_2{-}CH_2{-}SO_2)_nL \quad \text{(II)}$$

in which:

X represents a halogen atom such as chloride or bromide, n represents 1, 2, 3, or 4, L represents an organic linking group. This organic linking group may be an alkyl, alkene, aryl or mixed alkyl and aryl group (e.g., variously referred to in the art as alkaryl or aralkyl or arylalkyl groups) e.g., up to 20 carbon atoms. Specific examples of linking groups can be found in the silver halide photographic patents listed earlier.

The aryl ring may also carry substituents being selected from the class consisting of halogen (e.g., Br and Cl), hydroxy, amino, carboxy, alkyl and alkoxy.

Where the term group is used in describing substituents, substitution is anticipated on the substituent for example, alkyl group includes ether groups (e.g., $CH_3{-}CH_2{-}CH_2{-}O{-}CH_2{-}$), haloalkyls, nitroalkyls, carboxyalkyls, hydroxyalkyls, sulfoalkyls, etc. while the term alkyl includes only hydrocarbons. Substituents which react with active ingredients, such as very strongly electrophilic or oxidizing substituents, would of course be excluded as not being inert or harmless.

Specific examples of vinyl sulfone (VS) and β-halo sulfone (HS) antifoggants are set forth below, but the present invention should not be construed as being limited thereto.

Formula (I)

VS-1

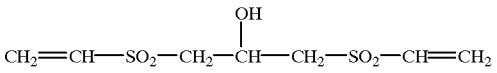

VS-2

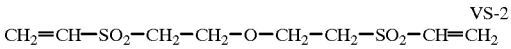

VS-3

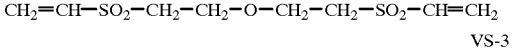

VS-4

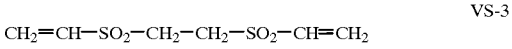

VS-5

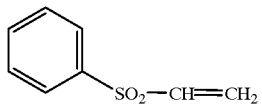

VS-6

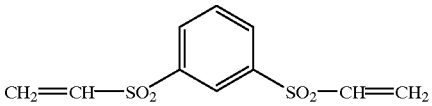

VS-7

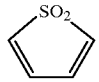

FORMULA (II)

HS-1

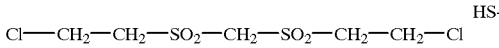

HS-2

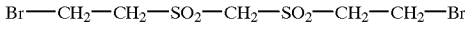

HS-3

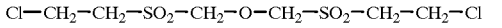

HS-4

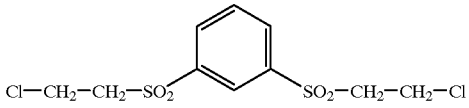

HS-5

The vinyl sulfone, VS-7, is not an exact fit to formula (I), although it would be close when n=1 and L is a vinyl group which connects to the methylene of the vinyl sulfone to form a 5-membered ring. The compound, VS-7, works as a fog stabilizer on shelf aging and shows that diverse vinyl sulfones and β-halo sulfones are effective antifoggants.

Vinyl sulfones and divinyl sulfones are well known in the literature such as U.S. Pat. Nos. 2,994,611; 3,061,436; 3,132,945; 3,490,911; 3,527,807; 3,539,644; 3,642,486; 3,642,908; 3,839,042; 3,841,872; 3,957,882, 4,088,495; 4,108,848; 4,137,082; and 4,142,897. They are also described in Belgium Patent 819,015 and U.S. Pat. No. 4,173,481.

The antifoggants are used in a general amount of at least 0.001 moles per mole of silver. Usually the range is between 0.01 and 5 moles of the compounds per mole of silver and preferably between 0.02 and 0.6 moles of compounds per mole of silver.

The photothermographic dry silver emulsions of this invention may be constructed of one or more layers on a substrate. Single layer constructions must contain the silver source material, the silver halide, the developer and binder as well as optional additional materials such as toners, coating aids, and other adjuvants. Two-layer constructions must contain the silver source and silver halide in one emulsion layer (usually the layer adjacent to the substrate) and some of the other ingredients in the second layer or both layers, although two layer constructions comprising a single emulsion layer containing all the ingredients and a protective topcoat are envisioned. Multicolor photothermographic dry silver constructions may contain sets of these bilayers for each color, or they may contain all ingredients within a single layer as described in U.S. Pat. No. 4,708,928. In the case of multilayer multicolor photothermographic articles the various emulsion layers are generally maintained distinct from each other by the use of functional or non-functional barrier layers between the various photosensitive layers as described in U.S. Pat. No. 4,460,681.

While not necessary for practice of the present invention, it may be advantageous to add mercury (II) salts to the emulsion layer(s) as an antifoggant. Preferred mercury (II) salts for this purpose are mercuric acetate and mercuric bromide.

The light sensitive silver halide used in the present invention may typically be employed in a range of 0.75 to 25 mol percent and, preferably, from 2 to 20 mol percent of organic silver salt.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to cubic, orthorhombic, tabular, tetrahedral, etc., and may have epitaxial growth of crystals thereon.

The silver halide used in the present invention may be employed without modification. However, it may be chemically sensitized with a chemical sensitizing agent such as a compound containing sulfur, selenium or tellurium etc., or a compound containing gold, platinum, palladium, rhodium or iridium, etc., a reducing agent such as a tin halide, etc., or a combination thereof. The details of these procedures are described in T. N. James "The Theory of the Photographic Process", Fourth Edition, Chapter 5, pages 149 to 169.

The silver halide may be added to the emulsion layer in any fashion which places it in catalytic proximity to the silver source. Silver halide and the organic silver salt which are separately formed or "preformed" in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are known in the art and described in *Research Disclosure*, June 1978, item 17029, and U.S. Pat. No. 3,700,458.

The use of preformed silver halide emulsions of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to cubic, tetrahedral, orthorhombic, tabular, laminar, platelet, etc.

The organic silver salt may be any organic material which contains a reducible source of silver ions. Silver salts of organic acids, particularly long chain (10 to 30 preferably 15 to 28 carbon atoms) fatty carboxylic acids are preferred. Complexes of organic or inorganic silver salts wherein the ligand has a gross stability constant between 4.0 and 10.0 are also desirable. The silver source material should preferably constitute from about 5 to 30 percent by weight of the imaging layer.

The organic silver salt which can be used in the present invention is a silver salt which is comparatively stable to light, but forms a silver image when heated to 80° C. or higher in the presence of an exposed photocatalyst (such as photographic silver halide) and a reducing agent.

Preferred organic silver salts include silver salts of organic compounds having a carboxy group. Non-limiting examples thereof include silver salts of an aliphatic carboxylic acid and a silver salt of an aromatic carboxylic acid. Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver linoleate, silver butyrate and silver camphorate, mixtures thereof, etc. Silver salts with a halogen atom or a hydroxyl on the aliphatic carboxylic acid can also be effectively used. Preferred examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can also be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, a silver salt of thioglycolic acid such as a silver salt of an S-alkyl thioglycolic acid (wherein the alkyl group has from 12 to 22 carbon atoms), a silver salt of a dithiocarboxylic acid such as a silver salt of dithioacetic acid, a silver salt of a thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of a thione compound such as a silver salt of 3-(2-carboxyethyl)-4-methyl-4-thiazoline-2-thione as disclosed in U.S. Pat. No. 3,301,678.

Furthermore, a silver salt of a compound containing an imino group may be used. Preferred examples of these compounds include silver salts of benzotriazole and derivatives thereof, for example, silver salts of benzotriazoles such as silver methylbenzotriazolate, etc., silver salt of halogen-substituted benzotriazoles, such as silver 5-chlorobenzotriazolate, etc., silver salts of carboimidobenzotriazole, etc., silver salt of 1,2,4-triazoles or 1-H-tetrazoles as described in U.S. Pat. No. 4,220,709, silver salts of imidazoles and imidazole derivatives, and the like. Various silver acetylide compounds can also be used, for instance, as described in U.S. Pat. Nos. 4,761,361 and 4,775,613.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver may be used.

The method used for making silver soap dispersions is well known in the art and is disclosed in *Research Disclosure*, April 1983, item 22812, *Research Disclosure*, October 1983, item 23419 and U.S. Pat. No. 3,985,565.

The light-sensitive silver halides may be advantageously spectrally sensitized with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Practically, the sensitizing dyes to be used in the present invention may be properly selected from known dyes such as those described in U.S. Pat. Nos. 3,761,279, 3,719,495, and 3,877,943, British Pat. Nos. 1,466,201, 1,469,117 and 1,422,057, and can be located in the vicinity of the photocatalyst according to known methods. Spectral sensitizing dyes may be typically used in amounts of about $10^{-4}$ mol to about 1 mol per 1 mol of silver halide.

The reducing agent for the organic silver salt may be any material, preferably organic material, that can reduce silver ion to metallic silver. Conventional photographic developers such as phenidone, hydroquinones, and catechol are useful but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent tend to be more desirable.

A wide range of reducing agents have been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionyl-β-phenylhydrazide in combination with ascorbic acid; a combination of polyhydroxybenzene and hydroxylamine, a reductone and/or a hydrazine (e.g., a combination of hydroquinone and bis (ethoxyethyl)hydroxylamine, piperidinohexose reductone or formyl-4-methylphenylhydrazine); hydroxamic acids such as phenylhydroxamic acid, p-hydroxyphenylhydroxamic acid, and β-alaninehydroxamic acid; a combination of azines and sulfonamidophenols, (e.g., phenothiazine and 2,6-dichloro-4-benzenesulfonamidophenol); α-cyanophenylacetic acid derivatives such as ethyl-α-cyano-2-methylphenylacetate, ethyl α-cyanophenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-β-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidonehexose reductone;

sulfonamido-phenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols (e.g., bis(2-hydroxy-3-t-butyl-5-methylphenyl) methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane); ascorbic acid derivatives (e.g., 1-ascorbyl palmitate, ascorbyl stearate); and unsaturated aldehydes and ketones, such as benzil and biacetyl; 3-pyrazolidones and certain indane-1,3-diones.

In addition to the aforementioned ingredients, it may be advantageous to include additives known as "toners" that improve the image. Toner materials may be present, for example, in amounts from 0.1 to 10 percent by weight of all silver bearing components. Toners are well known materials in the photothermographic art as shown in U.S. Pat. Nos. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline, and 2,4-thiazolidinedione; naphthalimides (e.g., N-hydroxy-1,8-naphthalimide); cobalt complexes (e.g., cobaltic hexammine trifluoroacetate); mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, (e.g., (N,N-dimethylaminomethyl)phthalimide, and N,N-(dimethylaminomethyl)naphthalene-2,3-dicarboximide); and a combination of blocked pyrazoles, isothiuronium derivatives and certain photobleaching agents (e.g., a combination of N,N'-hexamethylene bis(1-carbamoyl-3,5-dimethylpyrazole), 1,8-(3,6-diazaoctane)bis(isothiuronium trifluoroacetate) and 2-(tribromomethylsulfonyl) benzothiazole); and merocyanine dyes such as 3-ethyl-5[(3-ethyl-2-benzothiazolinylidene)-1-methylethylidene]-2-thio-2,4-oxazolidinedione; phthalazinone and phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulfinic acid derivatives (e.g., phthalic acid, 4-methylphthalic acid, 4-nitrophthalic acid, and tetrachlorophthalic anhydride); quinazolinediones, benzoxazine or naphthoxazine derivatives; rhodium complexes functioning not only as tone modifiers, but also as sources of halide ion for silver halide formation in situ, such as ammonium hexachlororhodate (III), rhodium bromide, rhodium nitrate and potassium hexachlororhodate (III); inorganic peroxides and persulfates (e.g., ammonium peroxydisulfate and hydrogen peroxide); benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymmetric triazines (e.g., 2,4-dihydroxypyrimidine, 2-hydroxy-4-aminopyrimidine), azauracils, and tetrazapentalene derivatives (e.g, 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene).

A number of methods are known in the art for obtaining color images with dry silver systems including: a combination of silver benzotriazole, well known magenta, yellow and cyan dye-forming couplers, aminophenol developing agents, a base release agent such as guanidinium trichloroacetate and silver bromide in poly(vinyl butyral) as described in U.S. Pat. Nos. 4,847,188 and 5,064,742; preformed dye release systems such as those described in U.S. Pat. No. 4,678,739; a combination of silver bromoiodide, sulfonamidophenol reducing agent, silver behenate, poly (vinyl butyral), an amine such as n-octadecylamine and 2-equivalent or 4-equivalent cyan, magenta or yellow dye-forming couplers; leuco dye bases which oxidize to form a dye image (e.g., Malachite Green, Crystal Violet and pararosaniline); a combination of in situ silver halide, silver behenate, 3-methyl-1-phenylpyrazolone and N,N'-dimethyl-p-phenylenediamine hydrochloride; incorporating phenolic leuco dye reducing agents such as 2(3,5-di-(t-butyl)-4-hydroxyphenyl)-4,5-diphenylimidazole, and bis(3,5-di-(t-butyl)-4-hydroxyphenyl)phenylmethane, incorporating azomethine dyes or azo dye reducing agents; silver dye bleach processes (for example, an element comprising silver behenate, behenic acid, poly(vinyl butyral), poly(vinyl-butyral)peptized silver bromoiodide emulsion, 2,6-dichloro-4-benzenesulfonamidophenol, 1,8-(3,6-diazaoctane)bis (isothiuronium-p-toluenesulfonate) and an azo dye can be exposed and heat processed to obtain a negative silver image with a uniform distribution of dye, and then laminated to an acid activator sheet comprising polyacrylic acid, thiourea and p-toluenesulfonic acid and heated to obtain well defined positive dye images); and amines such as aminoacetanilide (yellow dye-forming), 3,3'-dimethoxybenzidine (blue dye-forming) or sulfonamide (magenta dye forming) that react with the oxidized form of incorporated reducing agents such as 2,6-dichloro-4-benzenesulfonamidophenol to form dye images. Neutral dye images can be obtained by the addition of amines such as behenylamine and panisidine.

Leuco dye oxidation in such silver halide systems for color formation is disclosed in U.S. Pat. Nos. 4,021,240, 4,374,821, 4,460,681 and 4,883,747.

Silver halide emulsions containing the antifoggants of this invention can be protected further against the additional production of fog and can be stabilized against loss of sensitivity during shelf storage. Suitable antifoggants, stabilizers, and stabilizer precursors which can be used alone or in combination, include thiazolium salts as described in U.S. Pat. Nos. 2,131,038 and 2,694,716; azaindenes as described in U.S. Pat. Nos. 2,886,437 and 2,444,605; mercury salts as described in U.S. Pat. No. 2,728,663; urazoles as described in U.S. Pat. No. 3,287,135; sulfocatechols as described in U.S. Pat. No. 3,235,652; oximes as described in British Pat. No. 623,448; nitrones; nitroindazoles; polyvalent metal salts as described in U.S. Pat. No. 2,839,405; thiouronium salts as described in U.S. Pat. No. 3,220,839; and palladium, platinum and gold salts described in U.S. Pat. Nos. 2,566,263 and 2,597,915; halogen-substituted organic compounds as described in U.S. Pat. Nos. 4,108,665 and 4,442,202; triazines as described in U.S. Pat. Nos. 4,128,557; 4,137,079; 4,138,265; and 4,459,350; and phosphorous compounds as described in U.S. Pat. No. 4,411,985.

Emulsions of the invention can contain plasticizers and lubricants such as polyalcohols (e.g., glycerin and diols of the type described in U.S. Pat. No. 2,960,404); fatty acids or esters such as those described in U.S. Pat. No. 2,588,765 and U.S. Pat. No. 3,121,060; and silicone resins such as those described in British Pat. No. 955,061.

The photothermographic elements of the present invention may include image dye stabilizers. Such image dye stabilizers are illustrated by British Pat. No. 1,326,889; U.S. Pat. Nos. 3,432,300; 3,698,909; 3,574,627; 3,573,050; 3,764,337 and 4,042,394.

Photothermographic elements containing emulsion layers according to the present invention can be used in photographic elements which contain light absorbing materials and filter dyes such as those described in U.S. Pat. Nos. 3,253,921; 2,274,782; 2,527,583 and 2,956,879. If desired, the dyes can be mordanted, for example, as described in U.S. Pat. No. 3,282,699.

Photothermographic elements containing emulsion layers as described herein can contain matting agents such as starch, titanium dioxide, zinc oxide, silica, polymeric beads including beads of the type described in U.S. Pat. No. 2,992,101 and U.S. Pat. No. 2,701,245.

Emulsions in accordance with this invention can be used in photothermographic elements which contain antistatic or conducting layers, such as layers that comprise soluble salts (e.g., chlorides, nitrates, etc.), evaporated metal layers, ionic polymers such as those described in U.S. Pat. Nos. 2,861,056 and 3,206,312 or insoluble inorganic salts such as those described in U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymers are polyvinyl butyral, ethyl cellulose, methacrylate copolymers, maleic anhydride ester copolymers, polystyrene, and butadiene-styrene copolymers.

Optionally, these polymers may be used in combinations of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions containing a stabilizer according to the present invention may be coated on a wide variety of supports. Typical supports include polyester film, subbed polyester film, poly(ethylene terephthalate)film, cellulose nitrate film, cellulose ester film, poly(vinyl acetal) film, polycarbonate film and related or resinous materials, as well as glass, paper, metal and the like. Typically, a flexible support is employed, especially a paper support, which may be partially acetylated or coated with baryta and/or an α-olefin polymer, particularly a polymer of an α-olefin containing 2 to 10 carbon atoms such as polyethylene, polypropylene, ethylene-butene copolymers and the like. Substrates may be transparent or opaque.

Substrates with a backside resistive heating layer may also be used in photothermographic imaging systems such as shown in U.S. Pat. Nos. 4,460,681 and 4,374,921.

Photothermographic emulsions of this invention can be coated by various coating procedures including dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Pat. No. 837,095.

Additional layers may be incorporated into photothermographic articles of the present invention such as dye receptive layers for receiving a mobile dye image, an opacifying layer when reflection prints are desired, a protective topcoat layer and a primer layer as is known in the photothermographic art. Additionally, it may be desirable in some instances to coat different emulsion layers on both sides of a transparent substrate, especially when it is desirable to isolate the imaging chemistries of the different emulsion layers.

The present invention will be illustrated in detail in the following examples, but the embodiment of the present invention is not limited thereto.

EXAMPLES 1–9

A silver halide-silver behenate dry soap was prepared by the procedures described in U.S. Pat. No. 3,839,049. The silver halide totalled 9% of the total silver while silver behenate comprised 91% of the total silver. The silver halide was a 0.055 micron silver bromide emulsion.

A photothermographic emulsion was prepared by homogenizing 300 g of the silver halide-silver behenate dry soap described above with 525 g toluene, 1675 g 2-butanone and 50 g poly(vinylbutyral) (B-76, Monsanto).

The homogenized photothermographic emulsion (500 g) and 100 g 2-butanone were cooled to 55° F. with stirring. Additional poly(vinylbutyral) (75.7 g B-76) was added and stirred for 20 minutes. Pyridinium hydrobromide perbromide (PHP, 0.45 g) was added and stirred for 2 hours. The addition of 3.25 ml of a calcium bromide solution (1 g of $CaBr_2$ and 10 ml of methanol) was followed by 30 minutes of stirring. The temperature was raised to 70° F. and the following were added in 15 minute increments with stirring:

3 g of 2-(4-chlorobenzoyl)benzoic acid

D-1 Dye solution (8.8 mg of IR Dye, D-1, in 7.1 g DMF)

4.2 g of supersensitizer solution (0.17 g 2-mercaptobenzimidazole, MBI, and 4 g methanol)

16.2 g 1,1-bis(2-hydroxy-3,5-dimethylphenyl)-3,5,5-trimethylhexane.

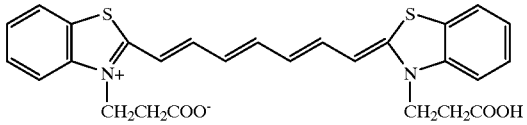

The photothermographic emulsion was split into 40 g portions at this stage for the various coating trials.

The photothermographic emulsion was coated on 3 mil ($0.76\times10^{-4}$ m) polyester base by means of a knife coater and dried at 175° F. for four minutes. The dry coating weight was 23 g/m$^2$.

An active, protective topcoat solution was prepared with the following ingredients:

256.0 g acetone 123.0 g 2-butanone 50.0 g methanol 20.2 g cellulose acetate 2.89 g phthalazine 1.55 g 4-methylphthalic acid 1.01 g tetrachlorophthalic acid 0.90 g tetrabromophthalic anhydride 1.50 g tetrachlorophthalic anhydride 2.25 g 2-(tribromomethylsulfone)benzothiazole [AF-1]

The resulting composition was divided into 20 g portions. Each 20 g portion of topcoat was just sufficient to coat a 40 g aliquot of the silver formula described previously. Therefore, a specific weight of a test compound added to either 20 g of topcoat formula or 40 g of silver formula will result in the same molar ratio of test compound to silver per unit area of coated photothermographic film. The vinyl sulfones were added as solids in Examples 1–9 to 20 g aliquots of topcoat solution. The topcoat solutions were coated over the silver layer at a dry weight of 3.0 g/m$^2$. The layer was dried at 165° F. for four minutes.

The coated materials were then exposed with a laser sensitometer incorporating a 780 nm diode. After exposure, the film strips were processed at 260° F. for ten seconds. The images obtained were evaluated by a densitometer. Sensitometric results include $D_{min}$, $D_{max}$, speed (relative speed at a density of 1.0 above $D_{min}$ versus a control without additive set at 100) and average contrast (cont, measured as the slope of the line joining density points of 0.25 and 2.0 above $D_{min}$). The sensitometry was evaluated shortly after coating (initial), after incubation (Inc.) for a specified time at 120° F. and 50% RH and after shelf aging at room temperature.

The results are compiled in Table 1 and show that vinyl sulfones are effective antifoggants and can greatly reduce the fog increase that occurs during shelf aging for these infrared sensitized, photothermographic materials.

TABLE 1

| Ex. | VS | Grams VS per 20 g TC* | % VS in TC | Initial Sensitometry $D_{min}$ | Initial Sensitometry $D_{max}$ | Initial Sensitometry Speed | Initial Sensitometry Cont | 7 day Inc. $D_{min}$ | 2 Months Shelf Aging $D_{min}$ | 2 Months Shelf Aging $D_{max}$ | 2 Months Shelf Aging Speed | 2 Months Shelf Aging Cont |
|---|---|---|---|---|---|---|---|---|---|---|---|---|
| A | none | — | — | 0.11 | 3.06 | 100 | 3.68 | 0.20 | 0.20 | 3.10 | 186 | 2.33 |
| 1 | VS-1 | 0.028 | 0.14 | 0.10 | 3.09 | 107 | 3.66 | 0.12 | 0.14 | 3.10 | 126 | 2.49 |
| 2 | VS-1 | 0.056 | 0.28 | 0.10 | 3.11 | 98 | 3.77 | 0.11 | 0.12 | 3.09 | 89 | 3.47 |
| 3 | VS-1 | 0.084 | 0.42 | 0.11 | 3.17 | 95 | 3.69 | 0.12 | 0.12 | 3.00 | 81 | 2.60 |
| 4 | VS-2 | 0.028 | 0.14 | 0.11 | 3.13 | 110 | 3.64 | 0.12 | 0.14 | 3.17 | 107 | 2.53 |
| 5 | VS-2 | 0.056 | 0.28 | 0.11 | 3.18 | 117 | 3.58 | 0.11 | 0.11 | 2.85 | 68 | 2.50 |
| 6 | VS-2 | 0.084 | 0.42 | 0.11 | 3.13 | 120 | 3.82 | 0.11 | 0.11 | 3.01 | 81 | 2.54 |
| 7 | VS-3 | 0.028 | 0.14 | 0.11 | 3.05 | 105 | 3.68 | 0.12 | 0.12 | 3.11 | 98 | 2.92 |
| 8 | VS-3 | 0.056 | 0.28 | 0.11 | 3.14 | 102 | 3.79 | 0.11 | 0.10 | 3.01 | 77 | 2.95 |
| 9 | VS-3 | 0.084 | 0.42 | 0.11 | 3.01 | 110 | 3.65 | 0.12 | 0.11 | 2.98 | 77 | 2.96 |

TC = Topcoat

EXAMPLES 10–27

Additional compounds were examined to determine the extent of the invention. A compound (VS-5, phenyl vinyl sulfone) with only a single vinyl sulfone was tested along with a series of β-halo sulfones. The formulas were the same as described in Examples 1–9 except that a 0.055 micron grain was used with a halide composition of 2% iodide and 98% bromide.

The results are tabulated in Table 2 and show that the mono-vinyl sulfone and β-halo sulfones are useful shelf life antifoggants for photothermographic materials.

EXAMPLES 28 and 29

Bis vinyl sulfones are common hardening agents in gelatin-silver halide systems. They have also been used in a mixed photothermographic system described in U.S. Pat. No. 4,459,350. The construction has a silver behenate-poly (vinylbutyral) layer overcoated with a gelatin topcoat. The gelatin topcoat is crosslinked with a bis vinyl sulfone. However, the gelatin forms a strong barrier layer which does not permit the vinyl sulfone to penetrate into the silver layer. This is demonstrated in Examples C, D and E in Table 3.

TABLE 2

| Ex. | VS or HS | Grams VS or HS per 20 g TC | % VS or HS in TC | Initial Sensitometry $D_{min}$ | Initial Sensitometry $D_{max}$ | Initial Sensitometry Speed | Initial Sensitometry Cont | 7 day Inc. $D_{min}$ | 2 Months Shelf Aging $D_{min}$ | 2 Months Shelf Aging $D_{max}$ | 2 Months Shelf Aging Speed | 2 Months Shelf Aging Cont |
|---|---|---|---|---|---|---|---|---|---|---|---|---|
| B | none | — | — | 0.12 | 3.09 | 100 | 4.00 | 0.30 | 0.22 | 3.10 | 110 | 2.84 |
| 10 | VS-5 | 0.028 | 0.14 | 0.12 | 3.08 | 105 | 4.16 | 0.24 | 0.19 | 3.11 | 105 | 2.99 |
| 11 | VS-5 | 0.056 | 0.28 | 0.12 | 2.97 | 107 | 4.27 | 0.14 | 0.16 | 3.07 | 83 | 3.11 |
| 12 | VS-5 | 0.084 | 0.42 | 0.12 | 2.99 | 117 | 4.19 | 0.63 | 0.14 | 3.05 | 79 | 3.24 |
| 13 | HS-1 | 0.028 | 0.14 | 0.12 | 3.05 | 107 | 4.44 | 0.12 | 0.15 | 3.06 | 69 | 2.49 |
| 14 | HS-1 | 0.056 | 0.28 | 0.13 | 2.97 | 112 | 4.60 | 0.31 | 0.12 | 2.90 | 59 | 2.34 |
| 15 | HS-1 | 0.084 | 0.42 | 0.12 | 2.95 | 120 | 4.83 | black | 0.12 | 2.57 | 43 | 1.72 |
| 16 | HS-2 | 0.007 | 0.035 | 0.11* | 3.19 | 76 | 4.19 | 0.27 | 0.19 | 3.24 | 85 | 2.81 |
| 17 | HS-2 | 0.014 | 0.07 | 0.11* | 3.02 | 79 | 4.21 | 0.23 | 0.15 | 3.23 | 76 | 2.72 |
| 18 | HS-2 | 0.028 | 0.14 | 0.12* | 2.93 | 76 | 3.90 | 0.13 | 0.13 | 3.08 | 52 | 2.66 |
| 19 | HS-3 | 0.028 | 0.14 | 0.11 | 3.24 | 91 | 4.38 | 0.12 | 0.19 | 3.37 | 87 | 2.81 |
| 20 | HS-3 | 0.056 | 0.28 | 0.11 | 3.04 | 91 | 4.46 | 0.28 | 0.18 | 3.17 | 79 | 3.04 |
| 21 | HS-3 | 0.084 | 0.42 | 0.12 | 3.00 | 117 | 4.59 | 1.89 | 0.18 | 3.07 | 79 | 2.81 |
| 22 | HS-5 | 0.028 | 0.14 | 0.11 | 3.19 | 98 | 4.46 | 0.13 | 0.20 | 3.12 | 93 | 3.19 |
| 23 | HS-5 | 0.056 | 0.28 | 0.11 | 3.04 | 100 | 4.45 | 0.11 | 0.16 | 3.22 | 89 | 3.13 |
| 24 | HS-5 | 0.084 | 0.42 | 0.12 | 3.13 | 98 | 4.33 | 0.74 | 0.15 | 3.16 | 83 | 3.09 |
| 25 | HS-4 | 0.028 | 0.14 | 0.11 | 3.12 | 98 | 4.36 | 0.17 | 0.20 | 3.29 | 91 | 2.86 |
| 26 | HS-4 | 0.056 | 0.28 | 0.11 | 3.10 | 98 | 4.26 | 2.84 | 0.20 | 3.21 | 69 | 2.84 |
| 27 | HS-4 | 0.084 | 0.42 | 0.12 | 3.00 | 123 | 4.50 | 3.22 | 0.15 | 3.13 | 69 | 2.89 |

*Processed strips had yellow tint.

Example C used the same silver formula as described for Examples 1–9. This was overcoated at a dry weight of 3.0 g/m$^2$ with a gelatin topcoat formula described below and heated to 104° F.:

18.74 g DI water 1.00 g Gelatin (Rouselot inert gelatin)

0.126 g phthalazine 0.066 g 4-methylphthalic acid 0.044 g tetrachlorophthalic acid 0.020 g 4-tribromomethylpyrimidine (AF-2)

Table 3 shows that not a trace of an image was formed after exposure and processing which is evidence that gelatin forms a strong barrier layer and in this case does not allow the toners to reach the silver layer and generate an image.

The remaining examples in Table 3 were prepared by adding a premix to the silver formula described in Examples 1–9. The premix formula for Examples D, E, F and 28 was:

| | |
|---|---|
| 0.126 g | phthalazine |
| 0.066 g | 4-methylphthalic acid |
| 0.044 g | tetrachlorophthalic acid |
| 0.020 g | 4-tribromomethylpyrimidine (AF-2) |
| 5.9 g | 2-butanone |

The premix was added to a 40 g portion of silver just prior to coating and the coating gap increased to adjust for the dilution. The same procedure was used for Examples G and 29 except the premix was changed to:

| | |
|---|---|
| 0.126 g | phthalazine |
| 0.066 g | 4-methylphthalic acid |

-continued

| | |
|---|---|
| 0.044 g | tetrachlorophthalic acid |
| 0.050 g | 2-(tribromomethylsulfone)benzothiazole [AF-1] |
| 5.9 g | 2-butanone |

Examples D and E were overcoated with the following gelatin topcoats:

19 g DI water 1.0 g Gelatin (Rouselot inert gelatin)

The topcoat for Example E also contained 0.056 g of VS-1 per 20 g of gelatin topcoat. The data in Table 3 show that the incubation and shelf aging fog levels are not improved by adding the vinyl sulfone (VS-1) to the gelatin topcoat. The gelatin acts as a strong barrier layer and does not allow the vinyl sulfone to reach the silver layer and therefore, no antifoggant effects are observed.

Examples F, 28, G and 29 were overcoated with a cellulose acetate topcoat described below:

| | |
|---|---|
| 11.6 g | acetone |
| 5.3 g | 2-butanone |
| 2.2 g | methanol |
| 0.9 g | cellulose acetate |

The cellulose acetate (CA) topcoats for Examples 28 and 29 also contain vinyl sulfone (VS-1). The amount is given in Table 3, and the incubated and shelf aging fog levels are greatly improved when the vinyl sulfone is coated out of a CA/solvent topcoat where mixing of the two layers occurs.

TABLE 3

| | Layer* | | Topcoat | Grams VS-1 | Initial Sensitometry | | | | 15 day Inc. | 3 Months Shelf Aging | | | |
|---|---|---|---|---|---|---|---|---|---|---|---|---|---|
| Ex. | Toner/AF | AF | binder | per 20 g TC | $D_{min}$ | $D_{max}$ | Speed | Cont | $D_{min}$ | $D_{min}$ | $D_{max}$ | Speed | Cont |
| C | TC | AF-2 | Gel | 0 | | no trace | | | — | | | | |
| D | Ag | AF-2 | Gel | 0 | 0.12 | 3.20 | 100 | 3.40 | 0.28 | 0.18 | 3.06 | 68 | 2.78 |
| E | Ag | AF-2 | Gel | 0.056 | 0.12 | 3.23 | 100 | 3.89 | 0.30 | 0.22 | 2.93 | 77 | 2.72 |
| F | Ag | AF-2 | CA | 0 | 0.13 | 3.21 | 102 | 3.71 | 0.27 | 0.29 | 3.11 | 87 | 3.39 |
| 28 | Ag | AF-2 | CA | 0.056 | 0.13 | 3.20 | 107 | 3.82 | 0.11 | 0.14 | 3.08 | 59 | 4.12 |
| G | Ag | AF-1 | CA | 0 | 0.14 | 3.22 | 129 | 3.35 | 0.28 | 0.37 | 3.08 | 141 | 3.23 |
| 29 | Ag | AF-1 | CA | 0.056 | 0.15 | 3.08 | 132 | 3.85 | 0.12 | 0.18 | 3.00 | 100 | 4.21 |

*Added to 40 g of silver solution or 20 g of topcoat which would give the same quantity of ingredient per mole of coated silver.

EXAMPLES 30–37

A set of experiments were run to determine if the vinyl sulfones would be effective shelf aging antifoggants whether added to the silver or topcoat formula. An additional question to be answered was whether the vinyl sulfone effects would add to shelf aging antifoggant improvements produced by isocyanates covered in U.S. patent application Ser. No. 07/983,125 dated the same as this application bearing Attorney's File No. 48899USA5A and titled "Photothermographic Elements". The formulas used were the same as described in Examples 10–27 except for three changes. The vinyl sulfones were tested in the silver and topcoat formulas as described in Table 4 and to each 40 g aliquot of silver was added 0.04 g isocyanate (Desmodur N100, Mobay, aliphatic isocyanate) diluted with 2-butanone and 0.10 g of 2-(tribromomethylsulfone)benzothiazole (AF-1). No AF-1 was added to the topcoat formulation. The results in Table 4 show that the vinyl sulfones are effective in either layer and are additive with the isocyanate to produce the greatest fog stability on shelf aging.

The mixture was held overnight before adding the following:

| | |
|---|---|
| 6.3 g | 2,2'-methylenebis(4-ethyl-6-tertiarybutylphenol) |
| 1.8 ml | D-2 Dye solution (0.042 g D-2 dye and 25 g methanol) |
| 1.8 ml | D-3 Dye solution (0.09 g D-3 dye and 25 g methanol) |
| 1.4 ml | Isocyanate solution (5 g Desmodur N100 and 4.25 g 2-butanone) |
| 1.8 g | 2-(tribromomethylsulfone)benzothiazole (AF-1) |

TABLE 4

| | | Grams of VS | Grams of VS | Initial Sensitometry | | | | 3 Month Shelf Aging | | | |
|---|---|---|---|---|---|---|---|---|---|---|---|
| Ex. | VS | per 40 g Ag | per 20 g TC | $D_{min}$ | $D_{max}$ | Speed | Cont | $D_{min}$ | $D_{max}$ | Speed | Cont |
| H | none | 0 | 0 | 0.10 | 3.18 | 100 | 4.09 | 0.12 | 3.24 | 79 | 3.43 |
| 30 | VS-1 | 0.02 | 0 | 0.10 | 3.05 | 115 | 4.05 | 0.10 | 3.19 | 64 | 3.53 |
| 31 | VS-1 | 0.06 | 0 | 0.10 | 3.06 | 110 | 4.06 | 0.10 | 3.17 | 72 | 3.88 |
| 32 | VS-1 | 0 | 0.02 | 0.09 | 3.20 | 102 | 3.94 | 0.10 | 3.29 | 69 | 3.86 |
| 33 | VS-1 | 0 | 0.06 | 0.10 | 3.12 | 112 | 3.99 | 0.10 | 3.27 | 56 | 3.59 |
| 34 | VS-2 | 0.02 | 0 | 0.10 | 3.05 | 110 | 4.08 | 0.10 | 3.12 | 83 | 4.08 |
| 35 | VS-2 | 0.06 | 0 | 0.10 | 3.02 | 123 | 3.96 | 0.10 | 3.11 | 72 | 3.93 |
| 36 | VS-2 | 0 | 0.02 | 0.10 | 3.14 | 102 | 4.27 | 0.10 | 3.26 | 77 | 3.97 |
| 37 | VS-2 | 0 | 0.06 | 0.10 | 3.10 | 107 | 4.05 | 0.10 | 3.20 | 74 | 3.95 |

EXAMPLES 38–47

An in situ halidized photothermographic system sensitized to the blue-green region was also examined. A photothermographic emulsion was prepared by combining 206 g of a silver behenate full soap dispersion (converted to 26% silver by weight) with the following ingredients, each added in its listed order with mixing:

| | |
|---|---|
| 40.0 g | 2-butanone |
| 0.54 g | N-methylpyrrolidone |
| 5.4 ml | of $ZnBr_2$ solution (10 g $ZnBr_2$ and 100 ml of methanol) |

The mixture was held for 4 hours before adding the following:

| | |
|---|---|
| 3.6 g | poly(vinylbutyral) B-76 |
| 2.6 ml | pyridine solution (3.6 g pyridine and 71 g 2-butanone) |
| 27.5 g | poly(vinylbutyral) B-76 |
| 4.6 ml | NBS solution (0.67 g N-bromosuccinimide and 40 g 2-butanone) |

D-2

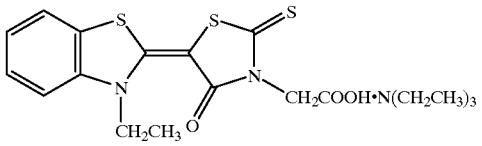

D-3

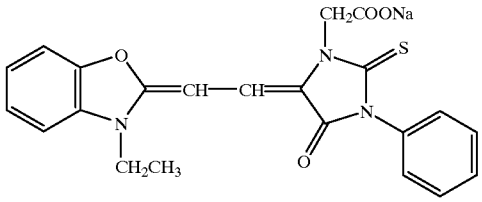

The resulting composition was divided into portions. The vinyl sulfone (VS-1) was added to coatings 38–42 in the dry weights listed in Table 5. The silver photothermographic emulsions were coated on clear 3 mil ($0.76\times10^{-4}$ m) polyester by means of a knife coater and dried at 185° F. for three minutes. The dry coating weight was 17 g/m$^2$.

An active, protective topcoat solution was prepared with the following ingredients:

| | |
|---|---|
| 224.0 g | 2-butanone |
| 33.3 g | acetone |

-continued

| | |
|---|---|
| 13.8 g | methanol |
| 20.7 g | cellulose acetate |
| 2.64 g | phthalazine |
| 1.86 g | 4-methylphthalic acid |
| 1.23 g | tetrachlorophthalic anhydride |
| 0.57 g | tetrachlorophthalic acid |

The resulting topcoat solution was divided into portions. The vinyl sulfone (VS-1) was added to coatings 43–47 in the dry weights listed in Table 5. The topcoat solutions were coated over the silver layer at a dry weight of 2.7 g/m$^2$ and dried at 185° F. for three minutes. The coated material was exposed on an EG&G sensitometer with a $10^{-3}$ second flash through a filter simulating a P-31 phosphor output. The film strips were processed at 260° F. for ten seconds. Speed and erg values are given for 1.0 density.

The results in Table 5 show the vinyl sulfone is a strong antifoggant in a blue-green, in situ photothermographic system. The best results are obtained by placing the vinyl sulfone, VS-1, in the topcoat.

TABLE 5

| | % VS-1 | | Initial Sensitometry | | | | |
|---|---|---|---|---|---|---|---|
| Ex. | Silver | Topcoat | $D_{min}$ | $D_{max}$ | Speed | Ergs | Cont |
| I | 0 | 0 | 0.08 | 3.03 | 2.89 | 12.9 | 2.37 |
| 38 | 0.05 | 0 | 0.08 | 2.81 | 2.91 | 12.5 | 2.03 |
| 39 | 0.10 | 0 | 0.08 | 2.85 | 2.91 | 12.4 | 1.97 |
| 40 | 0.20 | 0 | 0.09 | 2.72 | 2.89 | 12.9 | 1.97 |
| 41 | 0.30 | 0 | 0.09 | 2.76 | 2.90 | 12.5 | 1.94 |
| 42 | 0.40 | 0 | 0.09 | 2.65 | 2.91 | 12.3 | 1.99 |
| 43 | 0 | 0.05 | 0.08 | 2.96 | 2.94 | 11.6 | 2.47 |
| 44 | 0 | 0.10 | 0.09 | 3.01 | 2.93 | 11.7 | 2.45 |
| 45 | 0 | 0.20 | 0.09 | 2.95 | 2.92 | 11.9 | 2.48 |
| 46 | 0 | 0.30 | 0.09 | 2.90 | 2.91 | 12.3 | 2.39 |
| 47 | 0 | 0.40 | 0.09 | 2.94 | 2.92 | 11.9 | 2.38 |

| | 7 Day Inc. at 120° F./50% RH | | | | | 3 Month Shelf Aging | | | | |
|---|---|---|---|---|---|---|---|---|---|---|
| Ex. | $D_{min}$ | $D_{max}$ | Spd | Ergs | Cont | $D_{min}$ | $D_{max}$ | Spd | Ergs | Cont |
| I | 0.13 | 3.23 | 2.89 | 13.0 | 2.45 | 0.27 | 3.07 | 2.97 | 10.8 | 2.33 |
| 38 | 0.12 | 3.04 | 2.90 | 12.6 | 1.87 | 0.22 | 2.95 | 2.95 | 11.4 | 1.97 |
| 39 | 0.09 | 3.06 | 2.82 | 15.4 | 1.89 | 0.19 | 2.89 | 2.93 | 11.9 | 1.91 |
| 40 | 0.10 | 2.96 | 2.84 | 14.7 | 1.91 | 0.15 | 2.83 | 2.90 | 12.7 | 2.06 |
| 41 | 0.11 | 2.97 | 2.82 | 15.1 | 1.90 | 0.19 | 2.84 | 2.90 | 12.7 | 1.96 |
| 42 | 0.14 | 3.02 | 2.86 | 13.9 | 1.76 | 0.32 | 2.90 | 2.94 | 11.7 | 1.71 |
| 43 | 0.10 | 3.23 | 2.83 | 14.8 | 2.55 | 0.12 | 3.07 | 2.91 | 12.3 | 2.70 |
| 44 | 0.09 | 3.28 | 2.85 | 14.4 | 2.49 | 0.11 | 3.07 | 2.90 | 12.7 | 2.86 |
| 45 | 0.08 | 3.26 | 2.83 | 14.8 | 2.77 | 0.09 | 3.06 | 2.91 | 12.4 | 2.71 |
| 46 | 0.08 | 3.23 | 2.80 | 16.1 | 2.55 | 0.09 | 3.09 | 2.89 | 13.0 | 2.81 |
| 47 | 0.08 | 3.26 | 2.75 | 17.8 | 2.73 | 0.08 | 3.09 | 2.84 | 14.6 | 2.82 |

EXAMPLES 48–50

A green sensitized color photothermographic formula was tested to determine the scope of the invention.

A silver halide-silver behenate dry soap was prepared by the procedures described in U.S. Pat. No. 3,839,049. The silver halide totalled 9% of the total silver while silver behenate comprised 91% of the total silver. The silver halide was a 0.055 micron silver bromoiodide emulsion with 2% iodide.

A photothermographic emulsion was prepared by homogenizing 300 g of the silver halide-silver behenate dry soap described above with 525 g toluene, 1666 g 2-butanone and 9.0 g poly(vinylbutyral) (B76, Monsanto).

The homogenized photothermographic emulsion (73 g) and 14.6 g 2-butanone were cooled to 55° F. with stirring. The following were added while the temperature was maintained at 55° F.

| Ingredient | Mix |
|---|---|
| 11.7 g poly(vinylbutyral) (B-76) | 25 min |
| 0.02 g PHP | 1 hour |
| 0.02 g PHP | 1 hour |
| 0.02 g PHP | 4 hours |
| 0.39 g $CaBr_2$ solution (10% w/v in MeOH) hold overnight at 55° F. | 0.5 hour |

The silver photothermographic emulsion was completed on the second day by warming to 70° F. and then adding 5 g of green sensitizing dye solution (0.0013 g D-4 dye and 5 g MeOH).

D-4

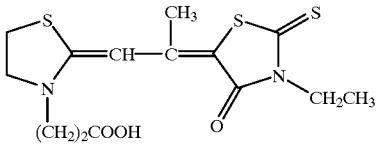

A premix (100 g) was also prepared by combining the chemicals listed below:

| | |
|---|---|
| 0.97 g | ethyl ketazine |
| 1.89 g | phthalazinone |
| 0.24 g | 2-(tribromomethylsulfone)benzothiazole (AF-1) |
| 85.80 g | tetrahydrofuran |
| 6.76 g | polyvinyl(chloride-acetate-alcohol) tripolymer (VAGH, Union Carbide) |
| 4.34 g | poly(vinylbutyral) (B-76, Monsanto) |

Ethyl Ketazine

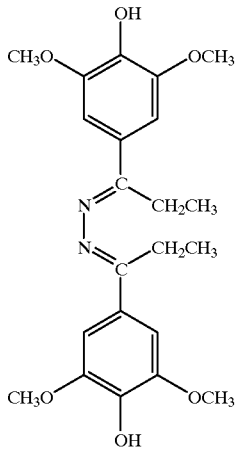

A mixture was prepared by combining 6 grams of the silver formulation with 13.5 grams of premix. The photothermographic mixture was coated on 3 mil ($0.76\times10^{-4}$ m) opaque polyester film filled with barium sulfate and dried at 170° F. for four minutes. The dry coating eight was 5 g/m$^2$.

An active, protective topcoat solution (100 g) was prepared with the following ingredients:

| | |
|---|---|
| 53.56 g | acetone |
| 26.44 g | 2-butanone |
| 10.68 g | toluene |
| 8.65 g | polystyrene (styrone 685D, Dow) |
| 0.67 g | (solvent, vinyl sulfone, isocyanate or combination) |

The topcoat solutions were coated over the silver layer at a dry weight of 3.5 g/m$^2$. The topcoat was dried at 170° F. for four minutes.

The coated materials were exposed for $10^{-3}$ seconds with a xenon flash from an EG&G sensitometer. The flash exposure was filtered with a green, Wratten 58 filter which has a maximum output at 530 nm. The film strips were then processed at 277°° F. for 8 seconds to generate a magenta colored image. Sensitometric results include $D_{min}$, $D_{max}$, Spd (speed at a density of 0.6 above fog), Ergs (speed or sensitivity at a density of 0.6 above fog) and cont (average contrast).

The results are compiled in Table 6 and show that vinyl sulfones limit the fog increase for a color photothermographic system.

TABLE 6

| | | Grams of VS | Initial Sensitometry | | | | | 24 Hour Inc. | 3 Month Shelf Aging | | | | |
|---|---|---|---|---|---|---|---|---|---|---|---|---|---|
| Ex. | VS | per 100 g TC | $D_{min}$ | $D_{max}$ | Speed | Ergs | Cont | $D_{min}$ | $D_{min}$ | $D_{max}$ | Speed | Ergs | Cont |
| J | none | — | 0.13 | 2.27 | 2.03 | 93 | 4.61 | 0.23 | 0.79 | 2.35 | 1.79 | 162 | 1.49 |
| 48 | VS-1 | 0.135 | 0.14 | 2.22 | 2.04 | 91 | 4.77 | 0.21 | 0.44 | 2.43 | 1.92 | 120 | 2.53 |
| 49 | VS-2 | 0.135 | 0.13 | 2.21 | 2.03 | 93 | 4.21 | 0.17 | 0.48 | 2.24 | 1.88 | 132 | 2.28 |
| 50 | VS-4 | 0.135 | 0.12 | 2.18 | 1.79 | 162 | 5.13 | 0.15 | 0.21 | 2.17 | 1.69 | 204 | 3.08 |

EXAMPLES 51 and 52

A further improvement on the present invention is to combine vinyl sulfones with isocyanates covered in U.S. patent Ser. File No. 07/983125 filed on Nov. 30, 1992, Attorney's File No. 48899USA5A.

The color photothermographic formulas were the same as presented in Examples 48–50 except that the preformed silver halide was 0.075$\mu$ and 100% bromide. The coatings summarized in Table 7 had 0.∂g of isocyanate (Desmodur N3300, Mobay) per 100 g of topcoat where indicated.

The data in Table 7 shows the combination of vinyl sulfone and isocyanate greatly improves the fog control on accelerated aging of the color photothermographic system.

TABLE 7

| | | | Grams of VS per 100 g | Initial Sensitometry | | | | | 7 Days at 120° F./50% RH | | | | |
|---|---|---|---|---|---|---|---|---|---|---|---|---|---|
| Ex. | Isocyanate | VS | Topcoat | $D_{min}$ | $D_{max}$ | Speed | Ergs | Cont | $D_{min}$ | $D_{max}$ | Speed | Ergs | Cont |
| K | No | none | none | 0.13 | 2.22 | 2.43 | 37 | 3.83 | 0.32 | 2.23 | 2.51 | 31 | 1.77 |
| L | Yes | none | none | 0.12 | 2.31 | 2.44 | 36 | 2.37 | 0.25 | 2.38 | 2.19 | 64 | 2.15 |
| 51 | Yes | VS-4 | 0.135 | 0.12 | 2.36 | 2.40 | 40 | 3.43 | 0.17 | 2.47 | 2.62 | 24 | 1.58 |
| 52 | Yes | VS-7 | 0.135 | 0.13 | 2.39 | 2.39 | 41 | 3.39 | 0.16 | 2.53 | 2.48 | 33 | 2.37 |

What is claimed is:

1. A black-and-white photothermographic emulsion comprising a silver salt of an organic acid, silver halide, a reducing agent for silver ion, a toner that is a phthalazine, and a hydrophobic polymer binder, said emulsion also containing an antifoggant comprising a vinyl sulfone.

2. The emulsion of claim 1 wherein said vinyl sulfone is represented by the formula:

$$(CH_2{=}CH{-}SO_2)_nL$$

wherein L is an organic linking group, and n is 1, 2, 3, or 4.

3. The emulsion of claim 2 wherein said vinyl sulfone is present in said emulsion and L is selected from the group consisting of alkyl group, aryl group, and mixed alkyl and aryl group.

4. A black-and-white photothermographic emulsion comprising a silver salt of an organic acid, silver halide, a toner that is a phthalazine, and a binder consisting essentially of a hydrophobic synthetic polymer binder, said emulsion also containing an antifoggant comprising a vinyl sulfone.

5. The emulsion of claim 4 wherein said vinyl sulfone is represented by the formula:

$$(CH_2{=}CH{-}SO_2)_nL$$

wherein L is an organic linking group, and n is 1, 2, 3, or 4.

6. The emulsion of claim 5 wherein said vinyl sulfone is present in said emulsion and L is selected from the group consisting of alkyl group, aryl group, and mixed alkyl and aryl group.

7. The emulsion of claim 6 wherein said binder is selected from the group consisting of polyvinyl acetals, polyvinyl chloride, polyvinyl acetate, polyolefins, polyesters, methacrylate copolymers, polystyrene, polyacrylonitribe, and butadiene-styrene copolymers.

8. The emulsion of claim 4 wherein said binder is selected from the group consisting of polyvinyl acetals, polyvinyl chloride, polyvinyl acetate, polyolefins, polyesters, methacrylate copolymers, polystyrene, polyacrylonitribe, and butadiene-styrene copolymers.

9. The emulsion of claim 5 wherein said binder is selected from the group consisting of polyvinyl acetals, polyvinyl chloride, polyvinyl acetate, polyolefins, polyesters, methacrylate copolymers, polystyrene, polyacrylonitribe, and butadiene-styrene copolymers.

10. A photothermographic emulsion comprising a silver salt of an organic acid, silver halide, a reducing agent for silver ion, a toner that is a phthalazine, and a hydrophobic polymer binder, said emulsion also containing an antifoggant comprising a vinyl sulfone with no hardening of said binder by said vinyl sulfone.

11. The emulsion of claim 10 wherein said vinyl sulfone is represented by the formula:

$$(CH_2{=}CH{-}SO_2)_nL$$

wherein L is an organic linking group, and n is 1, 2, 3, or 4.

12. The emulsion of claim 11 wherein said vinyl sulfone is present in said emulsion and L is selected from the group consisting of alkyl group, aryl group, and mixed alkyl and aryl group.

13. A photothermographic emulsion comprising a silver salt of an organic acid, silver halide, a reducing agent for silver ion, a toner that is phthalazine, and a binder consisting essentially of a hydrophobic polymer binder, said emulsion also containing an antifoggant comprising a vinyl sulfone which antifoggant does not harden said binder.

14. The emulsion of claim 13 wherein said vinyl sulfone is represented by the formula:

$$(CH_2{=}CH{-}SO_2)_nL$$

wherein L is an organic linking group, and n is 1, 2, 3, or 4.

15. The emulsion of claim 14 wherein said vinyl sulfone is present in said emulsion and L is selected from the group consisting of alkyl group, aryl group, and mixed alkyl and aryl group.

16. The emulsion of claim 13 wherein said binder is selected from the group consisting of polyvinyl acetals, polyvinyl chloride, polyvinyl acetate, polyolefins, polyesters, methacrylate copolymers, polystyrene, polyacrylonitrile, and butadiene-styrene copolymers.

17. The emulsion of claim 14 wherein said binder is selected from the group consisting of polyvinyl acetals, polyvinyl chloride, polyvinyl acetate, polyolefins, polyesters, methacrylate copolymers, polystyrene, polyacrylonitrile, and butadiene-styrene copolymers.

18. A photothermographic element comprising a substrate having on at least one surface thereof a single photothermographic emulsion layer comprising a silver salt of an organic acid, silver halide, a reducing agent for silver ion, a toner that is a phthalazine, and a binder, said emulsion containing an antifogging amount of a sulfone antifoggant comprising a vinyl sulfone said binder consisting of a hydrophobic polymer.

19. The element of claim 18 in which said sulfone antifoggant does not harden said binder.

20. The element of claim 18 in which said polymeric binder consists of a polyvinyl acetal.

21. The element of claim 19 in which said polymeric binder consists of a polyvinyl acetal.

22. The element of claim 20 in which said polyvinyl acetal is polyvinyl butyral.

23. The element of claim 21 in which said polyvinyl acetal is polyvinyl butyral.

24. The element of claim 18 wherein said emulsion comprises a black-and-white photothermographic emulsion.

* * * * *